US008568247B1

(12) United States Patent
Ehlers

(10) Patent No.: US 8,568,247 B1
(45) Date of Patent: Oct. 29, 2013

(54) GOLF CLUB HEAD WITH IMPROVED AERODYNAMIC CHARACTERISTICS

(75) Inventor: Steven M. Ehlers, Poway, CA (US)

(73) Assignee: Callaway Golf Company, Carlsbad, CA (US)

( * ) Notice: Subject to any disclaimer, the term of this patent is extended or adjusted under 35 U.S.C. 154(b) by 290 days.

(21) Appl. No.: 13/215,796

(22) Filed: Aug. 23, 2011

Related U.S. Application Data

(60) Provisional application No. 61/421,724, filed on Dec. 10, 2010.

(51) Int. Cl.
*A63B 53/02* (2006.01)
*A63B 53/04* (2006.01)

(52) U.S. Cl.
USPC ..... 473/305; 473/327

(58) Field of Classification Search
USPC ..... 473/324–350
See application file for complete search history.

(56) References Cited

U.S. PATENT DOCUMENTS

| | | | | | |
|---|---|---|---|---|---|
| 1,587,758 | A | * | 6/1926 | Charavay | 473/327 |
| 1,787,415 | A | * | 12/1930 | Washington | 473/315 |
| 2,910,297 | A | * | 10/1959 | Bonetate | 473/228 |
| 3,595,577 | A | * | 7/1971 | Hodge | 473/314 |
| 4,065,133 | A | | 12/1977 | Gordos | |
| 4,930,783 | A | | 6/1990 | Antonious | |
| 5,120,061 | A | | 6/1992 | Tsuchida et al. | |
| 5,203,565 | A | | 4/1993 | Murray et al. | |
| 5,230,347 | A | | 7/1993 | Weinstein et al. | |
| 5,318,297 | A | | 6/1994 | Davis et al. | |
| 5,451,048 | A | * | 9/1995 | Magamoto et al. | 473/347 |
| D364,906 | S | | 12/1995 | Schmidt et al. | |
| 5,575,725 | A | * | 11/1996 | Olsavsky | 473/317 |
| 5,674,136 | A | | 10/1997 | Gorse et al. | |
| 5,873,793 | A | * | 2/1999 | Swinford | 473/317 |
| 5,938,541 | A | * | 8/1999 | Allen et al. | 473/305 |
| 5,961,397 | A | | 10/1999 | Lu et al. | |
| 6,027,414 | A | | 2/2000 | Koebler | |
| 6,048,278 | A | | 4/2000 | Meyer et al. | |
| 6,050,903 | A | * | 4/2000 | Lake | 473/244 |
| 6,273,828 | B1 | * | 8/2001 | Wood et al. | 473/246 |
| 6,561,922 | B2 | * | 5/2003 | Bamber | 473/317 |
| 6,575,843 | B2 | * | 6/2003 | McCabe | 473/245 |
| 6,863,622 | B1 | * | 3/2005 | Hsu | 473/307 |
| 7,163,468 | B2 | | 1/2007 | Gibbs et al. | |
| 7,163,470 | B2 | | 1/2007 | Galloway et al. | |

(Continued)

FOREIGN PATENT DOCUMENTS

| | | | | | |
|---|---|---|---|---|---|
| JP | 06154366 | A | * | 6/1994 | A63B 53/04 |
| JP | 2000005351 | A | * | 1/2000 | A63B 53/02 |
| JP | 2001054594 | A | * | 2/2001 | A63B 53/02 |
| JP | 2005237535 | A | * | 9/2005 | A63B 53/02 |

*Primary Examiner* — Alvin Hunter
(74) *Attorney, Agent, or Firm* — Rebecca Hanovice; Michael A. Catania; Sonia Lari

(57) ABSTRACT

A golf club head comprising an aerodynamic hosel is disclosed herein. In one embodiment, the hosel may have an airfoil cross-section with a high thickness to chord ratio. In a further embodiment, the thickness to chord ratio may increase from a hosel head connection point to a hosel shaft connection point. In another embodiment, a shaft connection point of the hosel is closer to a club face vertical plane than to a head connection point vertical plane, e.g., is swept. In yet another embodiment, the hosel has an endplate proximate a shaft connection point. In yet another embodiment, the exterior surface of the hosel is rough, comprises at least one vertex generator, comprises a fillet, or comprises at least one trip step.

14 Claims, 13 Drawing Sheets

(56) References Cited

U.S. PATENT DOCUMENTS

| | | | | |
|---|---|---|---|---|
| 7,166,038 | B2 | 1/2007 | Williams et al. | |
| 7,214,143 | B2 | 5/2007 | Deshmukh | |
| 7,252,600 | B2 | 8/2007 | Murphy et al. | |
| 7,258,626 | B2 | 8/2007 | Gibbs et al. | |
| 7,258,631 | B2 | 8/2007 | Galloway et al. | |
| 7,273,419 | B2 | 9/2007 | Evans et al. | |
| 7,713,138 | B2 | 5/2010 | Sato et al. | |
| 7,951,013 | B1 * | 5/2011 | Snyder et al. | 473/228 |
| 8,177,659 | B1 * | 5/2012 | Ehlers | 473/305 |
| 8,192,299 | B2 * | 6/2012 | Sato et al. | 473/307 |
| 2005/0032584 | A1 | 2/2005 | Van Nimwegen | |
| 2009/0318245 | A1 | 12/2009 | Yim et al. | |
| 2010/0009771 | A1 | 1/2010 | Newcomer | |
| 2010/0016095 | A1 | 1/2010 | Burnett et al. | |
| 2010/0016096 | A1 | 1/2010 | Burnett et al. | |
| 2010/0016097 | A1 | 1/2010 | Albertsen et al. | |
| 2010/0292020 | A1 | 11/2010 | Tavares et al. | |
| 2010/0311517 | A1 | 12/2010 | Tavares et al. | |
| 2011/0136584 | A1 | 6/2011 | Boyd et al. | |

* cited by examiner

GOLF CLUB HEAD WITH IMPROVED AERODYNAMIC CHARACTERISTICS

CROSS REFERENCES TO RELATED APPLICATIONS

The present application claims priority to U.S. Provisional Patent Application No. 61/421,724, filed on Dec. 10, 2010.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head having a hosel configuration that improves the aerodynamic qualities of the golf club head.

2. Description of the Related Art

Technical innovation in the size, structure, configuration, material, construction, and performance of golf clubs has resulted in a variety of new products. The contribution of the hosel to overall drag of a club head can be significant, but it has largely been ignored by manufacturers and innovators even though the advent of adjustable hosel configurations with increased dimensions has resulted in a larger contribution to club head drag for some club head models. For low drag head shapes the contribution of the hosel becomes more important.

The hosel of a golf club head is the connection between the shaft and the head. It is typically circular in cross-section with a diameter that is larger than the shaft. Both tapered and constant cross-section approaches can be used. The hosel is a relatively small subcomponent of a golf club head, but it essentially travels at the same high speed as the head and is usually has a very aerodynamically inefficient shape. In addition, it operates in a flow field that is heavily influenced by larger club heads, particularly in drivers.

Although the prior art has disclosed many variations of golf club heads, including a variation disclosed in U.S. Pat. No. 1,587,758 (entitled "Golf Club") to Charavay, the prior art has failed to provide a club head with a hosel configuration that does not interfere with or have a negative effect on airflow during a swing.

BRIEF SUMMARY OF THE INVENTION

One aspect of the present invention is a golf club head comprising a face component, a crown, and a sole, and a hosel having a shaft connection point and a head connection point, wherein the hosel has an airfoil cross-section, wherein the airfoil cross-section has a thickness and a chord, and wherein the airfoil cross-section has a high thickness to chord ratio. The airfoil may have a Reynolds Number that is less than or equal to 70,000, and alternatively may have a Reynolds Number that is less than or equal to 100,000. The airfoil may be symmetric or cambered. The airfoil also may have one, two, or more slots. The airfoil may also have a truncated trailing end.

Another aspect of the present invention is a golf club head comprising a face component, a crown, and a sole, and a hosel having a shaft connection point and a head connection point, wherein the hosel has at least one thickness and at least one chord, wherein the hosel has a variable thickness to chord ratio, and wherein the thickness to chord ratio increases from the head connection point to the shaft connection Another aspect of the present invention is a golf club head comprising a face component, a crown, and a sole, and a hosel having a shaft connection point and a head connection point, wherein the hosel has at least one chord length. The chord length may remain constant from the head connection point to the shaft connection point of the hosel, it may decrease from the head connection point to the shaft connection point of the hosel, or it may increase from the head connection point to the shaft connection point of the hosel.

Another aspect of the present invention is a golf club head comprising a face component, a crown, and a sole, and a hosel having a shaft connection point and a head connection point, wherein the face component has a vertical plane and the head connection point has a vertical plane, and wherein the shaft connection point of the hosel is closer to the face component vertical plane than the head connection point vertical plane. The hosel may further be notched or staggered.

Another aspect of the present invention is a golf club head comprising a face component, a crown, and a sole, a hosel having a shaft connection point and a head connection point, and an endplate connected to the shaft connection point. The endplate may be planar or nonplanar.

Another aspect of the present invention is a golf club head comprising a face component, a crown, and a sole, and a hosel having a shaft connection point and a head connection point, wherein the hosel has an exterior surface, and wherein the exterior surface is not smooth. The exterior surface may be rough, may comprise at least one trip step, or may comprise at least one vortex generator.

Another aspect of the present invention is a golf club head comprising a face component, a crown, and a sole, and a hosel having a head connection point at the crown, wherein the head connection point comprises a fillet.

DETAILED DESCRIPTION OF THE INVENTION

The present invention is generally directed to a golf club head with a novel hosel configuration that reduces interference with airflow and thus reduced drag during a swing in comparison with hosel configurations of the prior art. The present invention also may conform to the Rules of Golf, which are established and interpreted by the United States Golf Association ("USGA") and The Royal and Ancient Golf Club of Saint Andrews and set forth certain requirements for a golf club head. The requirements for a golf club head are found in Rule 4 and Appendix II. Complete descriptions of the Rules of Golf are available on the USGA web page at www.usga.org.

Figure 4:
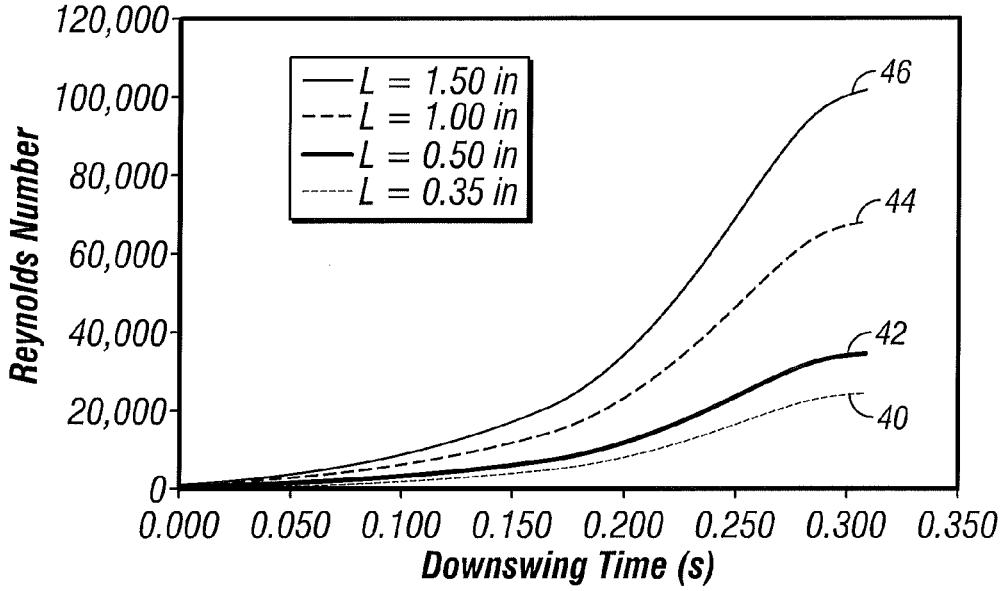
FIG. 4 is a graph showing Reynolds Number variation during downswing for several reference lengths.

According to the Rules, the shaft of a golf club must be attached to a wood club head at the club head heel either directly or through a single plain neck and/or socket. The length from the top of the neck and/or socket to the sole of the club must not exceed 5 inches (127 mm), measured along the axis of, and following any bend in, the neck and/or socket. The term "hosel," as it is used herein, refers to a piece that connects the golf club head with the shaft. This piece may be integrally formed with the golf club head or the shaft, or may be a separately formed piece that is attached to the golf club head and shaft through means known to persons of ordinary skill int heart. The term "aerodynamic hosel portion" refers to a non-circular or aerodynamic portion of the hosel than spans part, but not all, of the overall length of the hosel, Hosel-Related Drag The dominant contributor to hosel drag is profile or pressure drag resulting from separated flow which creates a low pressure region on the aft portions of the hosel. Skin friction drag generally is minimal. This effect is typical of circular cross-sections operating below the critical Reynolds Number, which is a measure of the ratio of inertial to viscous forces in a fluid flow and is given by:

$$Re = \frac{\rho V L}{\mu}$$

where ρ is air density, V is flow speed, L is a reference length and μ is air viscosity. FIG. 4 shows Reynolds Number variation during a typical downswing for several values of reference length. Head speed varies from zero to the maximum, which means the Reynolds Number does likewise.

Another element of hosel drag is interference drag resulting from the proximity of the hosel to the head. There are two components of interference drag in a golf club. First, the wake of the hosel impinges on the head, altering the flow and typically creating a low pressure region on the crown. Second, the hosel is operating in a high velocity flow created by the presence of the head. This amplifies the drag of the shaft creating an incremental drag force. Although interference drag is, in general, a small effect, it is worthy of consideration. Treatments that reduce profile drag of the hosel will also typically reduce interference drag.

Flow Characteristics

As discussed above, the hosel is positioned between the predominantly two dimensional flow about the shaft and the highly three dimensional and very unsteady flow in the vicinity of the head. During downswing the hosel is subjected to a wide range of speeds, with a peak speed very close to the maximum head speed. Of equal importance, however, is the range of flow angles. This aspect of the flow is very important for non-circular cross-sections.

Figure 1:
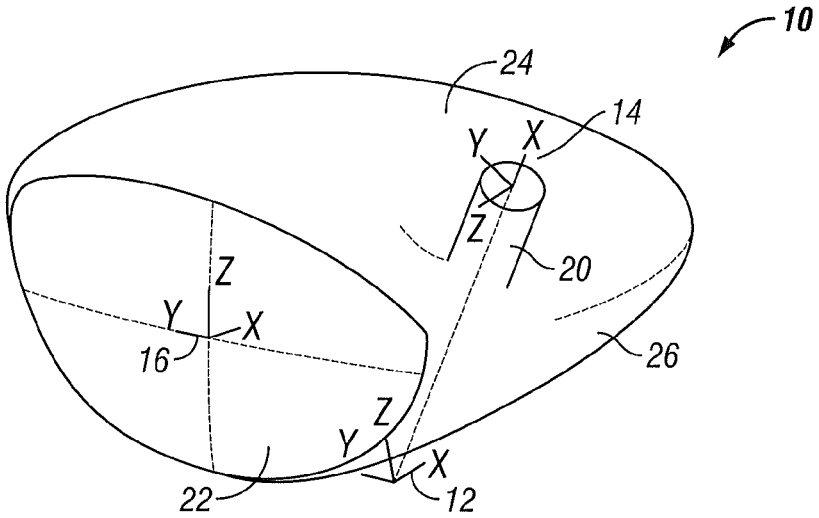
FIG. 1 is a side perspective view of a golf club head having three coordinate systems.
Figure 2:
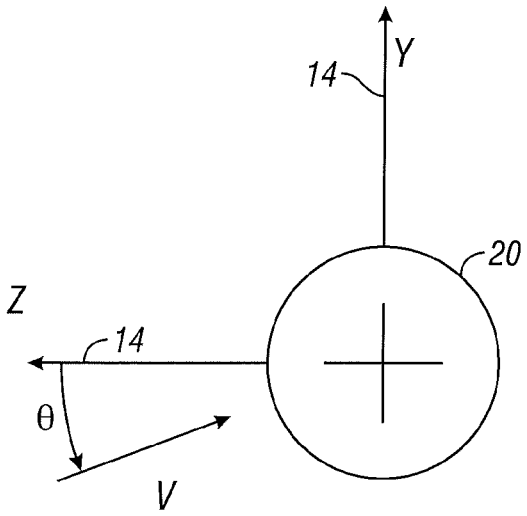
FIG. 2 is a top, cross-section view of the hosel shown in FIG. 1 with a hosel coordinate system.

FIG. 1 shows a golf club head 10 having a hosel 20, a face 22, a crown 24, and sole 26. The golf club head 10 of FIG. 1 has three major coordinate systems: the head coordinate system 12; the hosel coordinate system 14; and the impact coordinate system 16. FIG. 2 shows a sectional view of a typical hosel 20 as seen looking down the shaft axis towards the ground, as well as the x and y axes of the hosel coordinate system 14. FIG. 2 also shows the relative flow speed, V, which is the opposite of hosel velocity, and the flow angle, θ.

Figure 3:
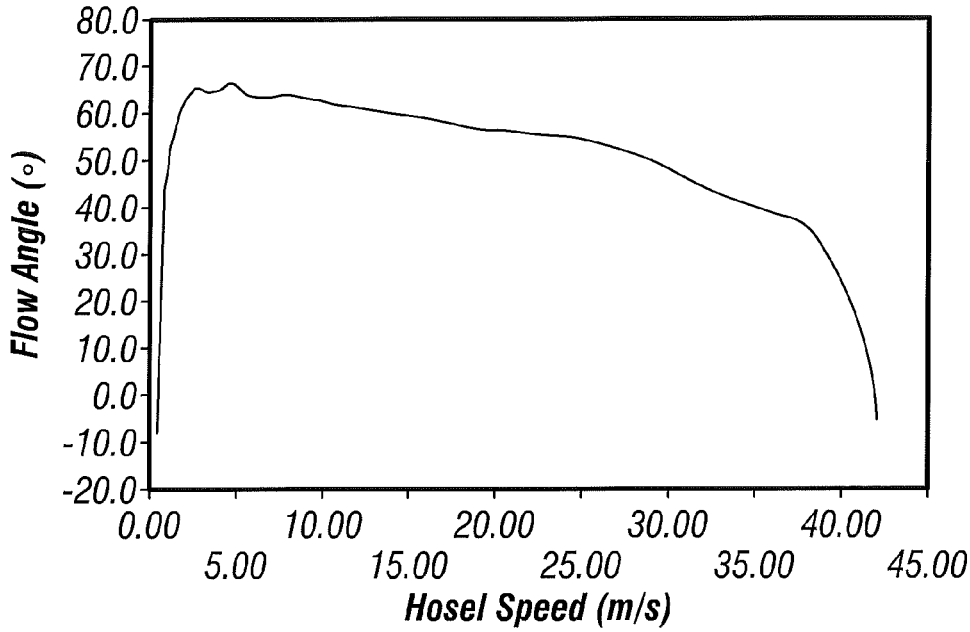
FIG. 3 is a graph showing hosel speed and flow angle variation during a downswing.

FIG. 3 shows the variation of the flow angle θ with flow velocity during a typical downswing with a head speed at impact of 100 mph. At the very earliest stages of the downswing, flow speeds are very low as the flow angle increases markedly. This is followed by a period of increasing speed and a near linear decline in flow angle. Just prior to impact, at the very highest flow speeds there is a rapid drop in flow angle. Flow about the hosel is also heavily influenced by the adjacent head, which accelerates flow velocities and affects flow directions. This leads to a much higher drag than would be experienced by a hosel alone on the end of a shaft subjected to a standard swing profile.

Referring to FIG. 4, the Reynolds Number for a shaft tip (L=0.35 inch) 40 stays below 25,000 while the value for a circular cross-section hosel (L=0.50 inch) 42 does not exceed 35,000. The Reynolds Number based on a reference length in the flow direction at impact is larger for noncircular cross-sections. For instance, a 2:1 ellipse with a thickness of 0.50 inch (the same as the circular hosel diameter) has a reference or chord length of 1.00 inch 44. In this case, the Reynolds Number approaches 70,000 at impact. A Reynolds Number in excess of 100,000 occurs near impact for an airfoil cross-section with a thickness ratio of 33%, which yields a reference length of 1.50 inches 46.

Figure 5:
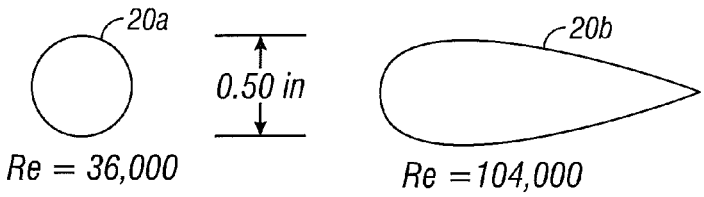
FIG. 5 is a top view of cross-sections of a circular hosel and an airfoil hosel.
Figure 6:
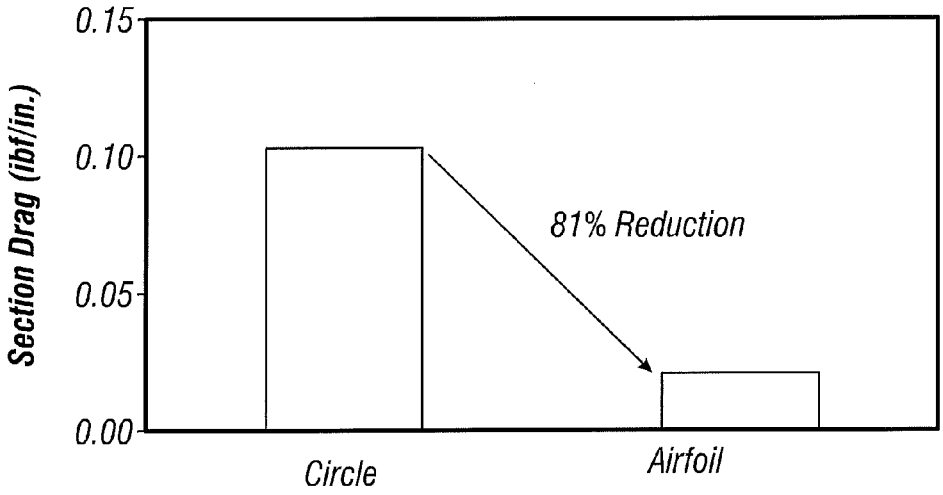
FIG. 6 is a chart showing the difference in section drag between a circular cross-section hosel and an airfoil cross-section hosel.

FIG. 5 illustrates the difference between Reynolds Numbers at 100 mph for a circular cross-section hosel 20*a* and one configuration of an airfoil cross-section hosel 20*b* having the same thickness. The present invention is not limited to this configuration. FIG. 6 demonstrates how an airfoil cross-section hosel has less than one fifth of the drag of a circle cross-section hosel of the same thickness at speeds of 100 to 160 mph.

Drag and Energy Loss

Aerodynamic drag of the hosel is a factor in overall club drag, and becomes more significant as drag of the head is reduced. As with the head, drag of the hosel varies significantly over the time of the downswing. Large changes are induced by significant changes in orientation. Overall drag force increases with the square of velocity.

Energy dissipated by drag is meaningful in that the goal of the downswing is to impart the maximum amount of energy to the club head, and hence the ball. Furthermore, this energy is supplied by a system with limited output: the golfer. Any energy lost to drag is not available at impact and degrades performance. In general, energy dissipated due to drag, or power loss, goes with the cube of velocity. This parameter is useful because it provides a weighting scheme, giving more weight to the higher velocity portions of the swing. And by integrating power loss over the period of the downswing, a total energy loss can be computed, resulting in a single figure of merit with which to compare various drag reduction methods. Different swings can also be compared with this approach.

Figure 7:
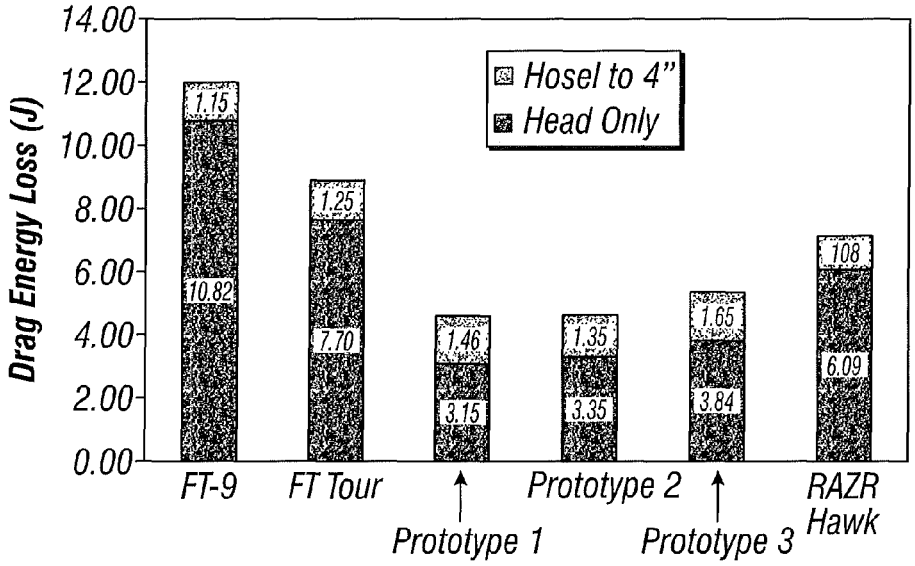
FIG. 7 is a chart showing drag energy loss, separated into head and hosel contributions, during the downswing of different clubs.

FIG. 7 shows the drag energy loss for several different Callaway Golf Company clubs, all of which have standard hosels and shafts. The energy loss is broken down into two components: the head only; and the hosel including portions of the shaft up to a four inch slant length along the shaft axis. FIG. 7 demonstrates that hosel drag becomes a more significant portion of overall drag as the drag of the head itself is reduced.

Drag Reduction Hosel Designs—Cross-Sections

The primary function of the hosel is attachment of the shaft to the club head. An improved approach to drag reduction, while retaining this primary function, depends on making adjustments to cross-sectional shape subject to dimensional and mass limitations, and aesthetic considerations. FIGS. 2 and 8-12 show cross-sectional hosel shapes 20 and the y and x axes of the hosel coordinate system 14.

When applied to circular cross-sections, the most straightforward route to drag reduction is simply reducing the outer diameter to a minimum. Reduction of thickness, or diameter, is limited by the outer diameter of the shaft, structural requirements of the shaft to hosel bond, and the hosel itself. Reducing the length dimension along the shaft axis is also possible with the limit being a no-hosel design. Some examples of reduced length hosels are disclosed in U.S. Pat. Nos. 5,320,347 and D364,906 and in Callaway Golf Company's S2H2 products. However, the shortened hosel is replaced by additional exposed shaft. The resulting drag benefit is not as great as it could be due primarily to the circular cross-section of the shaft. Furthermore, surface treatments that force transition of the boundary layer of a circular cross-section to turbulent flow and delay separation are not effective for typical hosel diameters of 0.50 inches and head speeds in the neighborhood of 100 mph. The Reynolds Number is very low at this dimension and speed, and there is too little energy in the flow and not enough flow path length to make such surface treatments effective.

Figure 8:
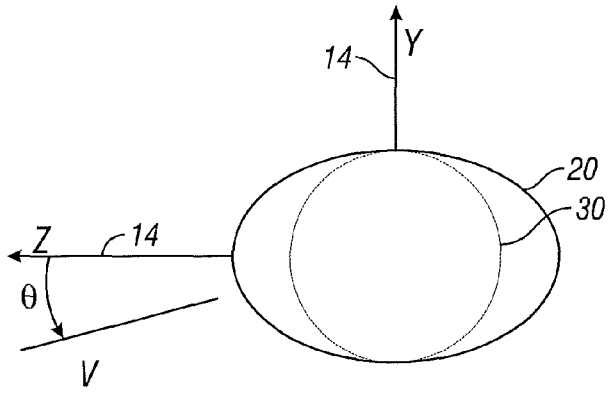
FIG. 8 is a top, cross-section view of an elliptical hosel with a hosel coordinate system.

Golf club manufacturers have limited ability to reduce the diameter of a circular cross-section. As such, non-circular sections present more significant opportunities for performance improvements. Elliptical cross sections such as the hosel example 20 shown in FIG. 8, however, do not yield a significant improvement in drag over a circular cross-section. A conventional hosel cross section 30 is represented in FIG. 8 with dashed lines. Various types of elliptical cross-sections have been studied for low speed applications, but their drag reduction potential is limited. Low aspect ratio sections behave similar to circular cross-sections. Higher aspect ratio elliptical cross-sections exhibit long chords which result in considerable blockage and separated flow at high flow angles experienced in the early and middle stages of downswing. Such cross-sections are also heavier and may have an adverse effect on head center of gravity position.

Use of an airfoil cross-section to reduce hosel drag has been attempted in the past, as evidenced by club designs and U.S. Pat. No. 1,587,758. However, these prior art club structures were not designed to function when subjected to the wide range of flow incidence angles encountered during the high speed phases of a downswing. Generally, and as shown in FIG. 3, the face is open in the late stages of the downswing resulting in a flow angle in the 30 to 60 degree range. Most airfoils will be in deep stall at these flow angles and exhibit very high drag.

Figure 9:
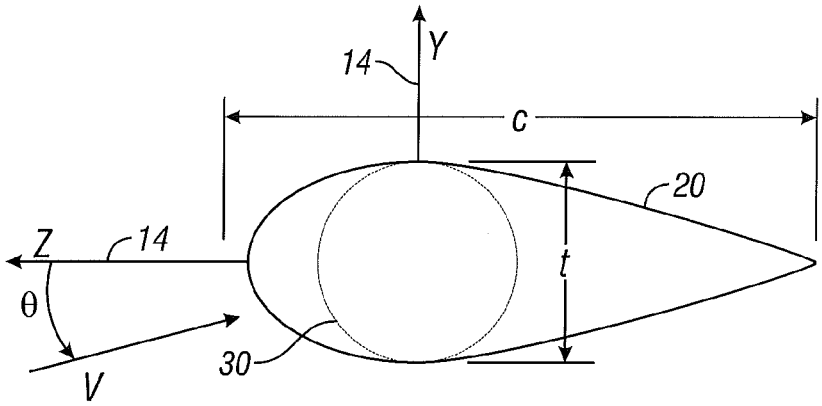
FIG. 9 is a top, cross-section view of a symmetrical airfoil hosel with a hosel coordinate system.

FIG. 9 shows a cross-section of an exemplary symmetric airfoil hosel 20, which can be contrasted with the conventional circular hosel dimension 30 represented with dashed lines. When incorporated with a hosel, either as an aerodynamic hosel portion or encompassing the entire length of the hosel, the airfoil cross-section should also exhibit a relatively high thickness (t) to chord (c) ratio, t/c, to minimize chord length. This reduces the blockage effect at very high angles of incidence, reduces the weight of the hosel, and simplifies integration with the body design. A generous leading edge radius is also necessary to permit the airfoil to function at a wide range of flow incidence angles. This characteristic also minimizes the distance from the leading edge to the shaft axis and facilitates meeting functional and rule limitations that require that the hosel not protrude beyond the plane of the face. The offset distance between the shaft axis and face of club head is also important from a performance and playability standpoint.

Figure 10:
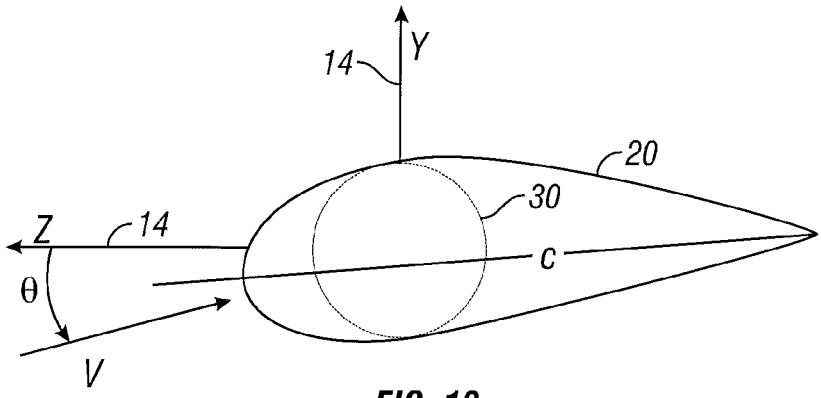
FIG. 10 is a top, cross-section view of a cambered airfoil hosel with a hosel coordinate system.

Another approach to dealing with the wide range of flow angles is to rotate the airfoil such that it is oriented nose down with respect to the hosel z-axis, as shown in FIG. 10. While this would serve to maintain attached flow and lower drag over a greater proportion of the downswing, it also would produce a force perpendicular to the swing plane near impact. This could severely affect playability by moving the club head from its intended path and altering the hit location.

A cambered airfoil hosel 20, shown in FIG. 10, can be used to bias the low drag flow angle range to coincide more closely with the angles experienced during the higher speed phase of the downswing immediately prior to impact. The cambered airfoil hosel 20 shown in FIG. 10 has 30% thickness, but is not limited to that thickness percentage. The cambered airfoil cross-section may be included in an aerodynamic hosel portion or may encompass the entire length of the hosel 20. However, a cambered airfoil hosel 20 also produces a force perpendicular to the swing plane. To minimize this effect, a cambered airfoil should be oriented with its zero lift line (ZLL) parallel to the hosel z-axis to eliminate out of swing plane forces and to minimize lift induced drag. Orienting the hosel airfoil cross-section in this manner will place the chord line at an angle to the target line at address. This may appear abnormal to the golfer, but using a reflex trailing edge may be helpful in eliminating this appearance while having minimal effect on the aerodynamic performance of the section.

Figure 11:
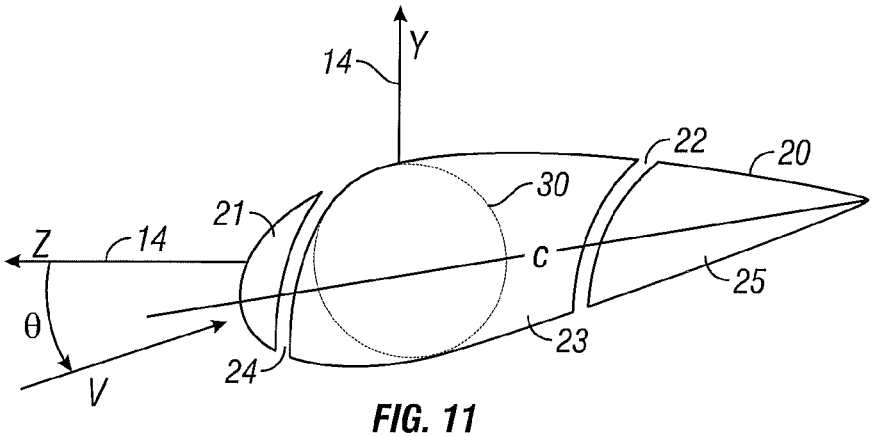
FIG. 11 is a top, cross-section view of a multi-element, cambered airfoil with a hosel coordinate system.

With certain airfoils, it is likely that airflow will be separated over the aft portions of the airfoils at low Reynolds Numbers typical of a golf swing. One approach to delaying separation is creating a multi-element or slotted airfoil. A three element 21, 23, 25 version of such a hosel 20 having two slots 22, 24 is shown in FIG. 11. The hosel 20 shown in FIG. 11 is cambered and has a 30% thick cross section, but may have other thickness percentages. Two element versions, which can be obtained by filling in either of the slots 22, 24 in the hosel 20 shown in FIG. 11, are also viable configurations. This multi-element or slotted configuration can be further generalized to include many slots and elements. This multi-element or slotted configuration may further comprise the entire length of the hosel, or be included as an aerodynamic hosel portion.

Figure 12:
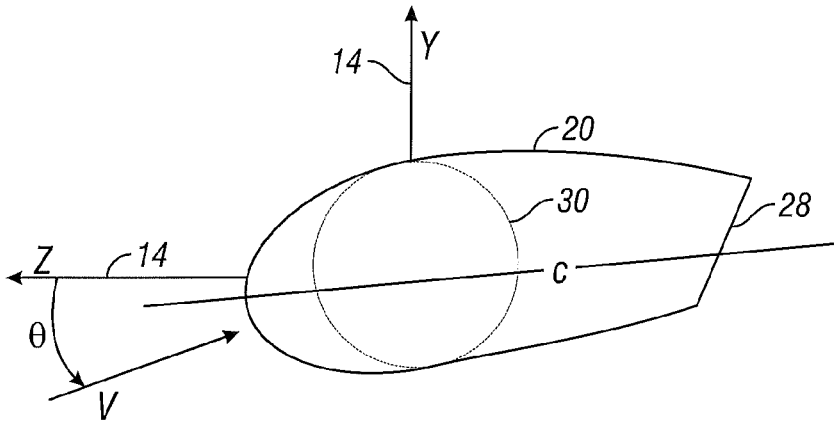
FIG. 12 is a top, cross-section view of an airfoil with a truncated trailing edge and a hosel coordinate system.

Another approach, shown in FIG. 12, involves truncating the trailing edge 28 portion of the airfoil hosel 20. This helps to reduce the blockage effect and resulting drag at high flow angles early in the swing. The mass of the hosel, and the resulting impact on head center of gravity, is also reduced by this approach. The chord-wise position and orientation of the truncation can be optimized to provide the maximum aerodynamic benefit at low mass and volume. The truncated trailing edge cross section may comprise the entire length of the hosel, or be included as an aerodynamic hosel portion.

Drag Reduction Configurations—Hosel Profiles

Figure 13A:
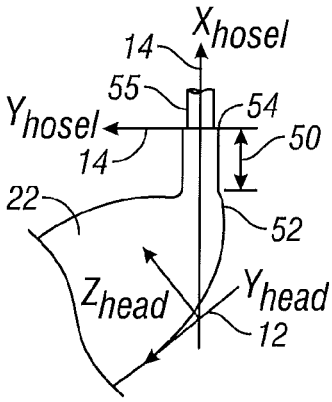
FIGS. 13A and 13B are front and side views, respectively, of a typical circular cross-section hosel and club head with a hosel coordinate system.
Figure 13B:
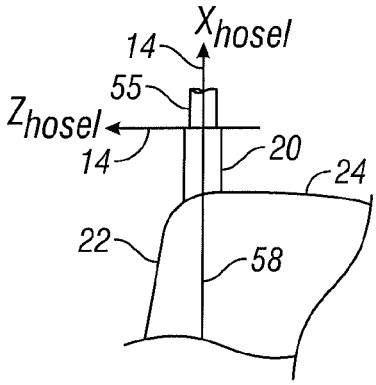
Figure 14:
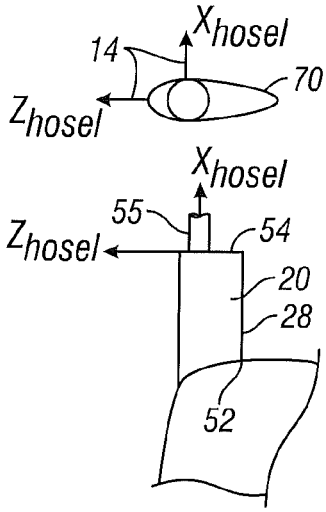
FIG. 14 is a side view of a first hosel style having a non-circular airfoil cross-section with a hosel coordinate system.
Figure 15A:
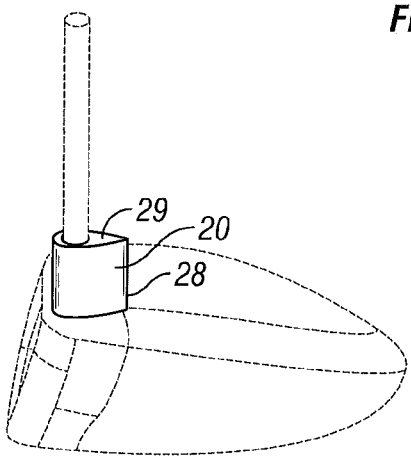
FIG. 15A is a side view of an embodiment of the hosel shown in FIG. 14.
Figure 15B:
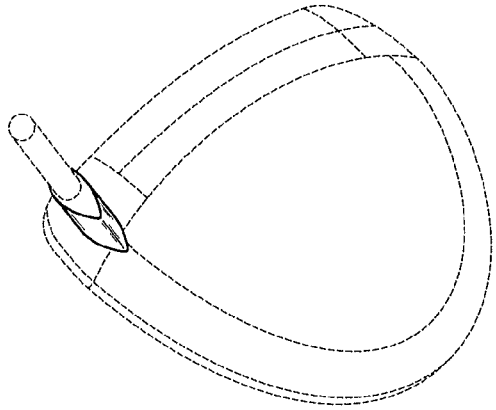
FIG. 15B is a top, perspective view of the embodiment shown in FIG. 15A.
Figure 16A:
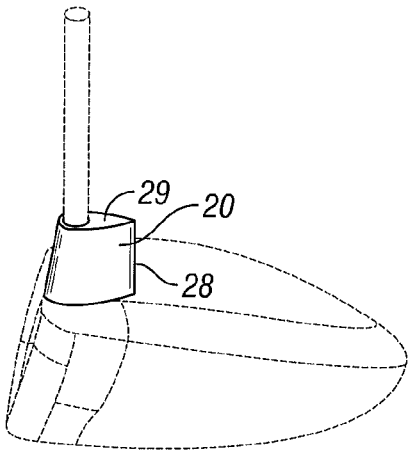
FIG. 16A is a side view of another embodiment of the hosel shown in FIG. 14.
Figure 16B:
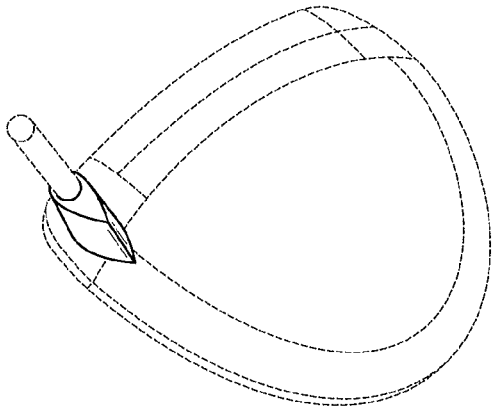
FIG. 16B is a top, perspective view of the embodiment shown in FIG. 16A.
Figure 17:
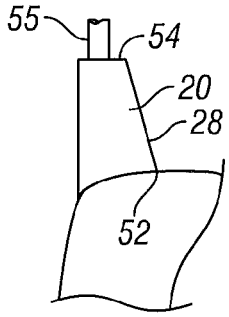
FIG. 17 is a side view of a second hosel style having a non-circular airfoil cross section.
Figure 18A:
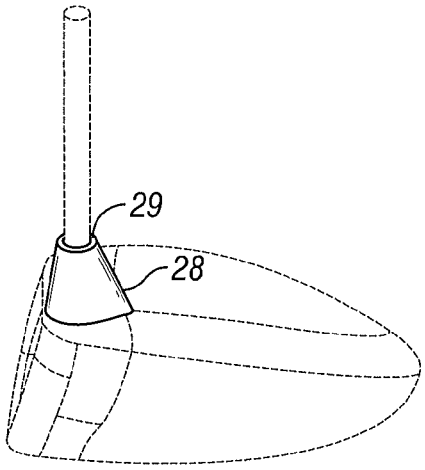
FIG. 18A is a side view of an embodiment of the hosel shown in FIG. 17.
Figure 18B:
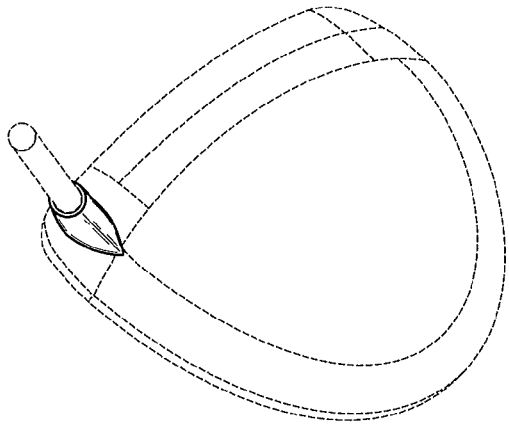
FIG. 18B is a top, perspective view of the embodiment shown in FIG. 18A.
Figure 19A:
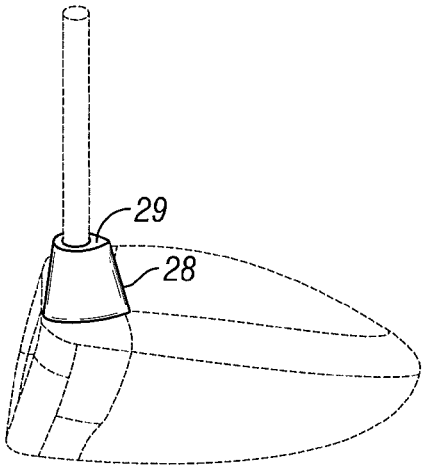
FIG. 19A is a side view of another embodiment of the hosel shown in FIG. 17.
Figure 19B:
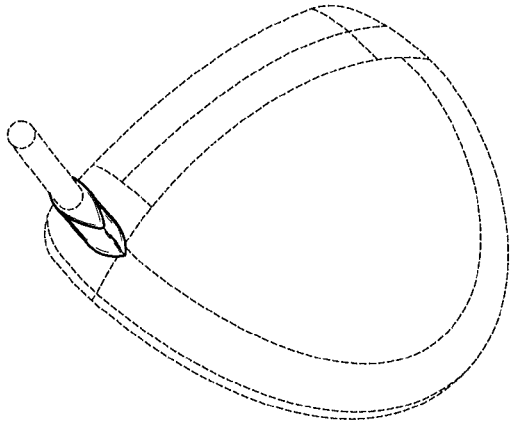
FIG. 19B is a top, perspective view of the embodiment shown in FIG. 19A.
Figure 20A:
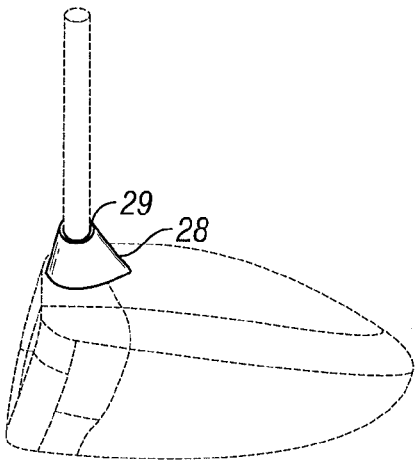
FIG. 20A is a side view of another embodiment of the hosel shown in FIG. 17.
Figure 20B:
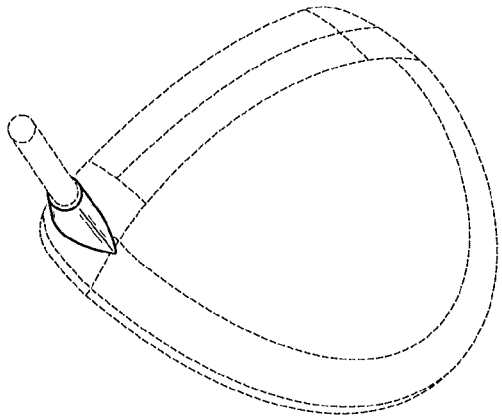
FIG. 20B is a top, perspective view of the embodiment shown in FIG. 20A.

Front and side views of a typical hosel installation are shown in FIGS. 13A and 13B, respectively. The distance from the hosel base 52, where it connects to the head, to the tip of the hosel 54, where the shaft 55 protrudes along the shaft axis 58, essentially constitutes the height 50 of the hosel 20. The magnitude of this dimension and variation in the configuration of the hosel 20 along this dimension is important for both aesthetic and performance reasons.

Several candidate non-circular or airfoil configurations are shown in FIGS. 14 to 22. The greatest aerodynamic benefit can be achieved with a full airfoil cross-section extending from the base to the tip of the hosel 20 (constant chord) without tapering significantly in length, embodiments of which are shown in FIGS. 14, 15A, 15B, 16A, and 16B. In these embodiments, the trailing edge 28 of the airfoil extends vertically upward from the crown 24 of the club head 10 at an approximately 90 degree angle with respect to the upper surface 29 of the hosel 20. In these embodiments, the drag reduction benefits of the airfoil cross-section are realized over the full height of the hosel.

Such a configuration can adversely affect mass properties of the head, however, by raising the center of gravity height, consuming valuable discretionary mass and possibly reducing key moment of inertia properties. This type of configuration may be also unacceptable from an aesthetic standpoint. As such, it is preferred that the aerodynamic hosel portion, the portion of the hosel having an airfoil cross section, be between 0.25 and 1.5 inches in height, and more preferably no greater than 1 inch in height. The remainder of the hosel may be cylindrical in cross-section.

Figure 21:
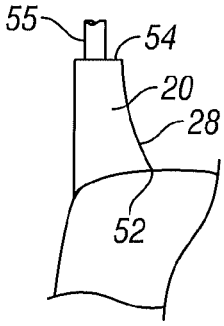
FIG. 21 is a side view of a third hosel style having a non-circular airfoil cross-section.
Figure 22:
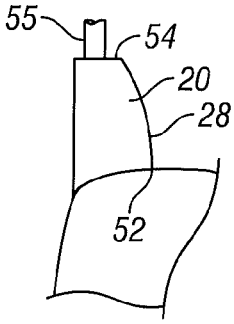
FIG. 22 is a side view of a fourth hosel style having a non-circular airfoil cross-section.

From an aesthetic standpoint, a tapered hosel 20 is preferred. Tapering also leads to a lower mass configuration, with less impact on head center of gravity position. FIGS. 17 through 21 show several different trailing edge hosel 20 shapes, in contrast with FIG. 22. In these embodiments, the trailing edge 28 of the airfoil extends vertically upwards at a non-90 degree angle with respect to the upper surface 29 of the hosel 20. The trailing edge 28 of the airfoil may curve as it extends from the crown 24 to the upper surface 29 of the hosel 20, as shown in FIGS. 21 and 22.

The simplest form would taper from an airfoil section at the base 52 to a circular cross-section at the tip 54. This approach, however, loses some of the benefit of the airfoil cross-section as the top of the hosel is approached. An alternative is to taper from a low thickness ratio section at the base 52 to a higher thickness ratio section at the tip 54. For instance a 33% thick airfoil at the hosel base 52 with a 0.5 inch thickness exhibits a 1.5 inch chord length. This tapers to a 50% thick airfoil at the top of the hosel, yielding a chord length of 1.00 inches for the same 0.50 inch thickness. The resulting taper ratio of 1.00/1.50 or 0.67 provides a more weight efficient and aesthetically pleasing hosel shape while maintaining low drag properties over the full height of the hosel.

The presence of the club head influences local flow directions and speeds, with the greatest effect occurring at the base of the hosel and diminishing towards the top of the hosel. As such, it is beneficial to change the airfoil orientation to compensate for differences in local flow direction along the hosel. This configuration appears as a twisting of the section from base to top.

Figure 23:
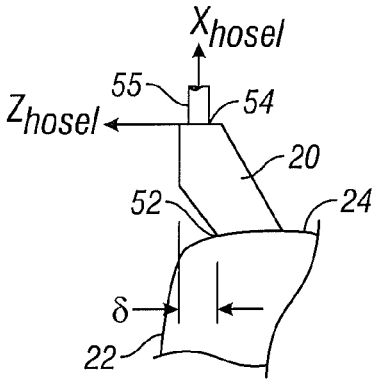
FIG. 23 is a side view of a swept hosel configuration with a hosel coordinate system.

A swept hosel, with the tip 54 of the hosel 20 closer to the plane of the driver face 22 than the base 52 presents some advantages. A basic swept hosel configuration is shown in FIG. 23. The junction of the hosel 20 and driver head 10 is moved aft by a distance δ into a lower velocity flow region. This geometric modification also moves the wake of the hosel base 52 further back on the crown 24. This is important for a good portion of the downswing, especially when the flow speeds and angles are high. Also, a spanwise component of flow, towards the hosel base, is created. This stabilizes the flow in the vicinity of the junction and results in reduced interference drag. The swept portion of this and other embodiments of the present invention may encompass the entire length of the hosel, or may be included as an aerodynamic hosel portion.

Figure 24:
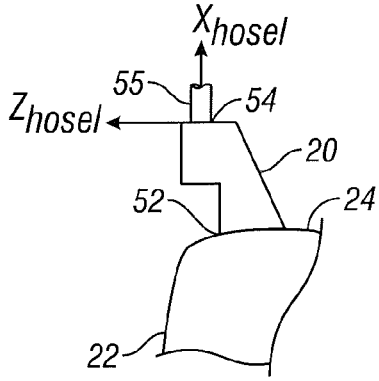
FIG. 24 is a side view of a swept, notched hosel configuration with a hosel coordinate system.
Figure 25:
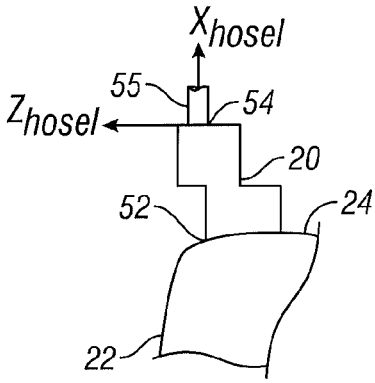
FIG. 25 is a side view of a swept, staggered hosel configuration with a hosel coordinate system.

Moving the base of the hosel aft also provides more design freedom for the shape of the face and contouring the heel corner below the hosel. This corner is essentially the "leading corner" for much of the downswing and it heavily influences aerodynamic behavior of the head. Proper shaping of this corner could result in significant drag reduction. For example, some of the same effects as a forward swept hosel can be achieved by notching the leading edge of the hosel base 52, as shown in FIG. 24. The height of the notch can be moderated to minimize aesthetic impact while preserving the aerodynamic benefits of sweep. A "staggered" configuration can also be achieved by notching the lower portion of the hosel leading edge near the base 52 as well as the upper portion of the trailing edge near the hosel tip 54, as shown in FIG. 25.

Figure 26A:
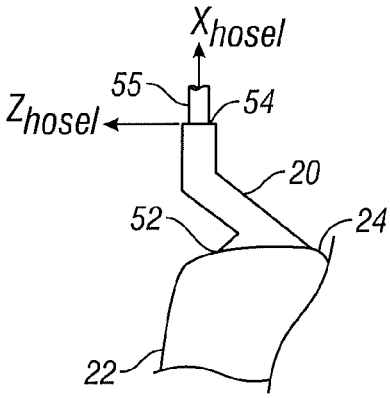
FIGS. 26A and 26B are side views of double swept or "snag" hosel configurations with hosel coordinate systems.
Figure 26B:
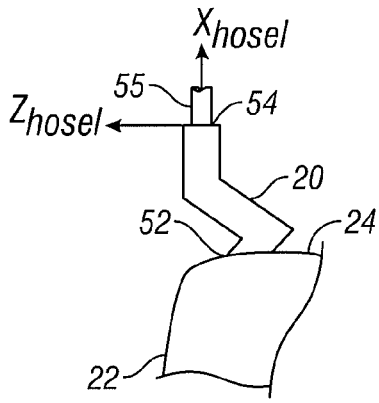
Figure 27A:
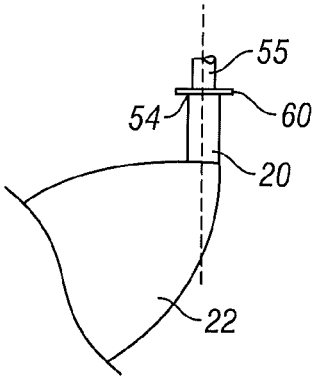
FIGS. 27A and 27B are front and side views, respectively, of a club head having an airfoil cross-section hosel with an endplate.
Figure 27B:
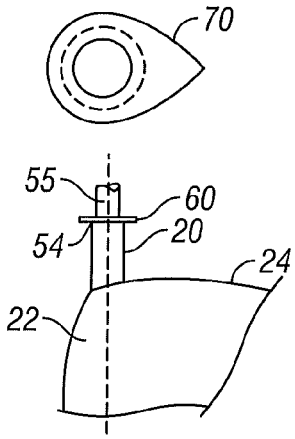
Figure 28A:
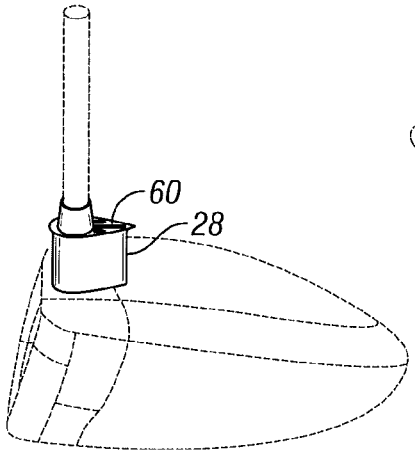
FIG. 28A is a side view of a first embodiment of the hosel shown in FIG. 27A.
Figure 28B:
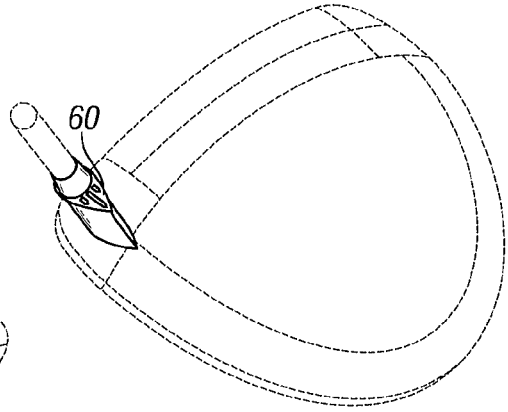
FIG. 28B is a top, perspective view of the embodiment shown in FIG. 28A.
Figure 29A:
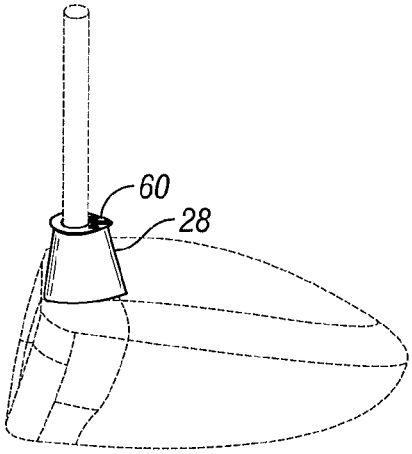
FIG. 29A is a side view of a second embodiment of the hosel shown in FIG. 27A.
Figure 29B:
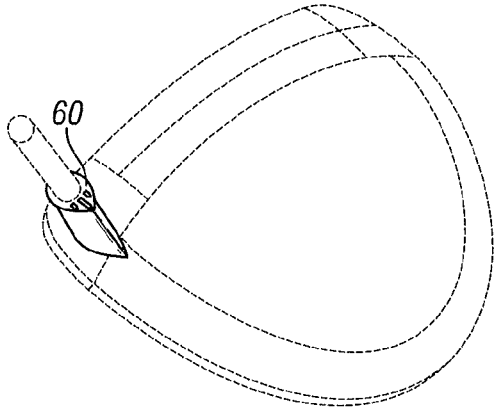
FIG. 29B is a top, perspective view of the embodiment shown in FIG. 29A.
Figure 30A:
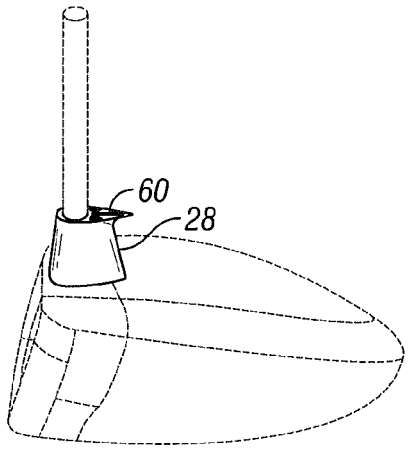
FIG. 30A is a side view of a third embodiment of the hosel shown in FIG. 27A.
Figure 30B:
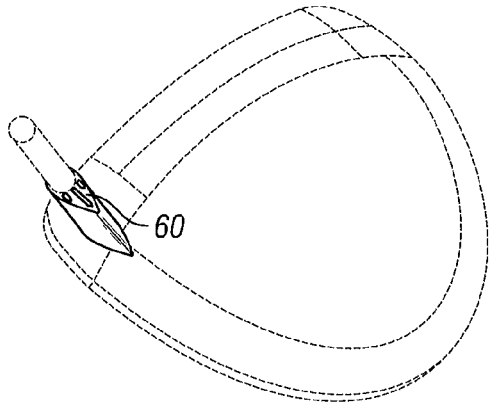
FIG. 30B is a top, perspective view of the embodiment shown in FIG. 30A.
Figure 31A:
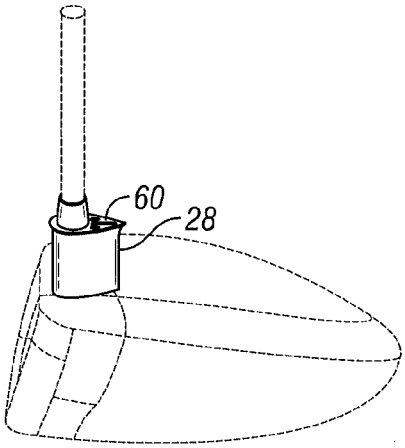
FIG. 31A is a side view of a fourth embodiment of the hosel shown in FIG. 27A.
Figure 31B:
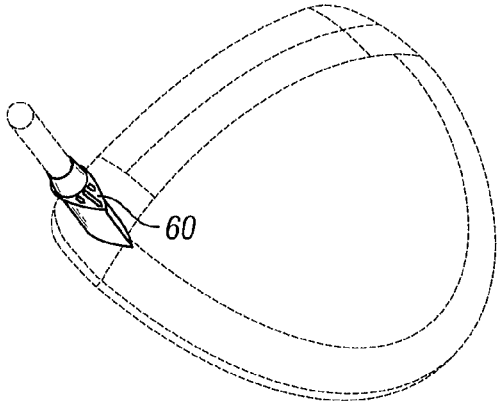
FIG. 31B is a top, perspective view of the embodiment shown in FIG. 31A.
Figure 32A:
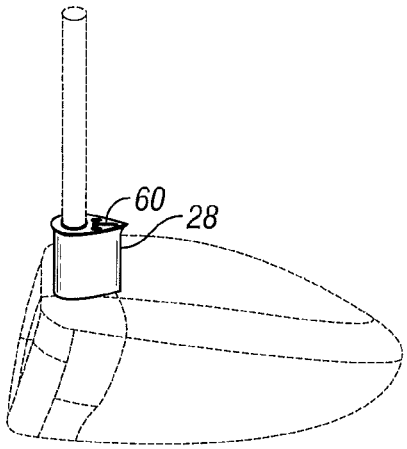
FIG. 32A is a side view of a fifth embodiment of the hosel shown in FIG. 27A.
Figure 32B:
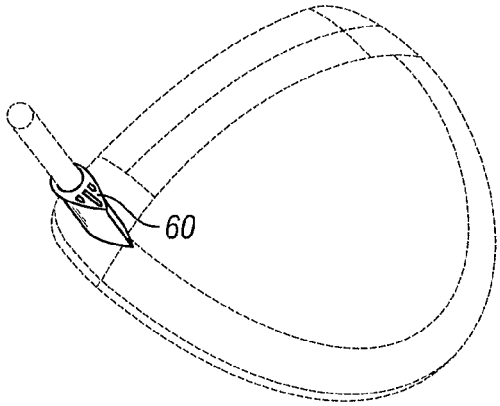
FIG. 32B is a top, perspective view of the embodiment shown in FIG. 32A.
Figure 33A:
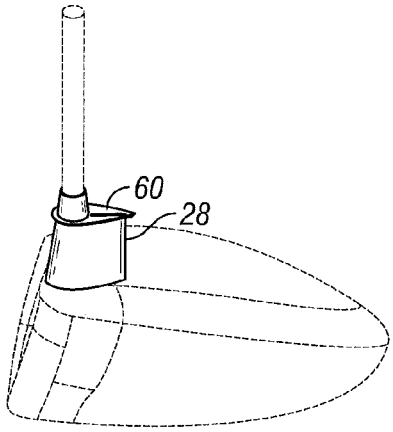
FIG. 33A is a side view of a sixth embodiment of the hosel shown in FIG. 27A.
Figure 33B:
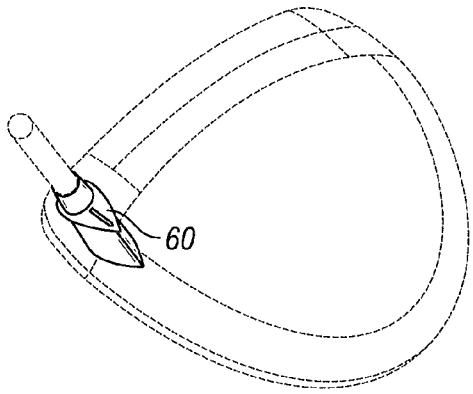
FIG. 33B is a top, perspective view of the embodiment shown in FIG. 33A.

Another version of the swept hosel 20 might include a lower portion that is swept towards the back of the head and an upper portion that is swept forward towards the shaft axis. The resulting shape presents a double swept or "snag" leading edge, two examples of which are shown in FIGS. 26A and 26B. This approach provides aft sweep for the flow region nearest the crown 24 while maintaining the position of the shaft 55 tip and providing for rearward attachment of the hosel 20 to the head 10.

Drag Reduction Configurations—Hosel Tip Treatments

The upper termination of the hosel, e.g., the hosel tip 54, or the upper termination of the aerodynamic hosel portion, is also important from an aesthetic standpoint. Various versions of rounded tip fairings can be implemented, or a very basic and abrupt cutoff can be used. An endplate, such as the endplates 60 shown in FIGS. 27A through 33B, provides aerodynamic benefits to a hosel, which may also have an airfoil cross section 70 or aerodynamic hosel portion. The purpose of the endplate 60 is to isolate the head airflow from the shaft flow to reduce interference effects. A basic endplate 60 configuration is planar and extends beyond the dimensions of the hosel end-plane in all directions. Its plan-form does not necessarily need be symmetric, but it extends farthest beyond the hosel end-plane in the flow direction at impact (hosel negative z-axis direction). A non-planar version of the endplate 60 can be shaped to preferentially influence either the shaft 55 or hosel 20 side flows. This can be achieved by curving the lateral or trailing edges of the endplate 60.

Drag Reduction Configurations—Hosel Surface Features and Base Treatments

Hosel dimensions in the flow direction generally are small relative to the head, but larger than the shaft. The resulting relatively low Reynolds Number operating range greatly restricts the type and effectiveness of surface features for reducing drag. Early in the swing, when the flow is at high incidence angles, an airfoil cross-section will experience mostly detached flow. That is, it is in a stalled condition, sometimes called deep stall. In this condition it is not functioning as an airfoil. The low drag benefits of the airfoil cross-section do not emerge until the flow is more closely aligned to the hosel Z-axis. It would be more beneficial for the hosel to act as a flow mixing device, much like a vortex generator, at high angles of incidence. This would inject higher energy air into the hosel wake and potentially reduce separation downstream of the hosel, which, in turn, would reduce drag. However, it is preferable for the hosel to retain its low drag airfoil characteristics at low incidence angles. The result is a "dual mode" hosel that is an airfoil at low incidence angles and a vortex generator at high angles of incidence.

Figure 34A:
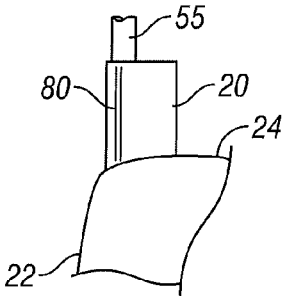
FIG. 34A is a side view of a club having a hosel with a trip step.
Figure 34B:
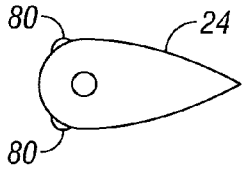
FIG. 34B is a top, cross-sectional view of the hosel shown in FIG. 34A.
Figure 35:
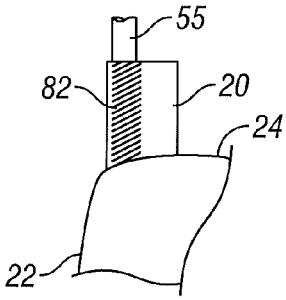
FIG. 35 is a side view of a club having a hosel with surface roughness.
Figure 36:
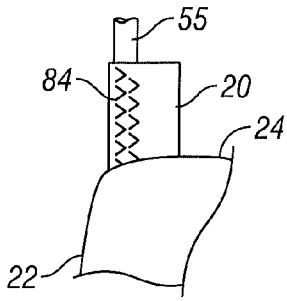
FIG. 36 is a side view of a club having a hosel with vortex generators.

One approach to achieving this functionality is to modify a hosel with an airfoil cross-section by the addition of certain features such as fins placed at appropriate orientations. The fins would cause flow mixing at high incidence angles but be aligned with the flow at low incidence angle to minimize drag and allow the airfoil cross-section of the hosel to function. As such, it is beneficial to add surface features such as trip strips 80, shown in FIGS. 34A and 34B, roughness 82, shown in FIG. 35, or vortex generators 84, shown in FIG. 36, to the forward portions of an airfoil or elliptical shaped hosel. Flow induced by the presence of the head will increase the local Reynolds Number of the hosel. This effect can be used to an advantage in that some surface geometries may become effective, especially for the portions of the hosel adjacent to the head.

The intersection of the hosel 20 and the head 10 creates a corner, which leads to formation of a necklace vortex and results in additional drag. The most straightforward way to reduce this drag is to create a fillet from the hosel wall to the crown surface. However, a trip feature, surface roughness, or vortex generators forward of the hosel base may also be useful in promoting attached turbulent flow and reducing the wake of the hosel.

Club Structure

In some embodiments of the present invention, the golf club head is a wood, e.g., a driver, fairway wood, or hybrid club. The golf club head of the present invention may be made from various materials, including, but not limited to, titanium and titanium alloys, magnesium, aluminum, tungsten, carbon or graphite composite, plastic, stainless steel, etc. In some embodiments, the entire club head is made of one material. In other embodiments, the club head is made of two or more materials. The golf club of the present invention may also have material compositions such as those disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein.

The golf club head of the present invention may be constructed to take various shapes, including traditional, square, rectangular, or triangular. In some embodiments, the golf club head of the present invention takes shapes such as those disclosed in U.S. Pat. Nos. 7,163,468, 7,166,038, 7,169,060, 7,278,927, 7,291,075, 7,306,527, 7,311,613, 7,390,269, 7,407,448, 7,410,428, 7,413,520, 7,413,519, 7,419,440, 7,455,598, 7,476,161, 7,494,424, 7,578,751, 7,588,501, 7,591,737, and 7,749,096, the disclosure of each of which is hereby incorporated in its entirety herein.

The golf club head of the present invention may also have variable face thickness, such as the thickness patterns disclosed in U.S. Pat. Nos. 5,163,682, 5,318,300, 5,474,296, 5,830,084, 5,971,868, 6,007,432, 6,338,683, 6,354,962, 6,368,234, 6,398,666, 6,413,169, 6,428,426, 6,435,977, 6,623,377, 6,997,821, 7,014,570, 7,101,289, 7,137,907, 7,144,334, 7,258,626, 7,422,528, 7,448,960, 7,713,140, the disclosure of each of which is incorporated in its entirety herein. The golf club of the present invention may also have the variable face thickness patterns disclosed in U.S. Patent Application Publication No. 20100178997, the disclosure of which is incorporated in its entirety herein.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim:

1. A golf club head comprising:
a face component, a crown, and a sole; and
a hosel having a shaft connection point and a head connection point;
wherein the hosel has an aerodynamic hosel portion,
wherein the aerodynamic hosel portion has a vertical length of between 0.25 and 1.5 inches,
wherein the aerodynamic hosel portion has a thickness and a chord,
wherein the aerodynamic hosel portion has a high thickness to chord ratio,
wherein the aerodynamic hosel portion is an airfoil, and
wherein the airfoil has a Reynolds Number that is less than or equal to 100,000.

2. The golf club head of claim 1, wherein the airfoil has a Reynolds Number that is less than or equal to 70,000.

3. The golf club head of claim 1, wherein the airfoil is symmetric.

4. The golf club head of claim 1, wherein the airfoil is cambered.

5. The golf club head of claim 1, wherein the airfoil has at least one slot.

6. A golf club head comprising:
a face component, a crown, a sole; and
a hosel having a shaft connection point and a head connection point;
wherein the hosel has an aerodynamic hosel portion,
wherein the aerodynamic hosel portion has a vertical length of between 0.25 and 1.5 inches,
wherein the aerodynamic hosel portion has a thickness and a chord,
wherein the aerodynamic hosel portion has a high thickness to chord ratio,
wherein the aerodynamic hosel portion is an airfoil, and
wherein the airfoil has two slots.

7. A golf club head comprising:
a face component, a crown, and a sole; and
a hosel having a shaft connection point and a head connection point;
wherein the hosel has an aerodynamic hosel portion,
wherein the aerodynamic hosel portion has a vertical length of between 0.25 and 1.5 inches,
wherein the aerodynamic hosel portion has a thickness and a chord,
wherein the aerodynamic hosel portion has a high thickness to chord ratio,
wherein the aerodynamic hosel portion is an airfoil, and
wherein the airfoil has a truncated trailing end.

8. A golf club head comprising:
a face component, a crown, and a sole; and
a hosel having a shaft connection point and a head connection point;
wherein the hosel has an aerodynamic hosel portion,
wherein the aerodynamic hosel portion has a vertical length of between 0.25 and 1.5 inches,
wherein the aerodynamic hosel portion has a thickness and a chord,
wherein the aerodynamic hosel portion has a high thickness to chord ratio, and
wherein an endplate is connected to the shaft connection point.

9. The golf club head of claim 8, wherein the endplate is planar.

10. The golf club head of claim 8, wherein the endplate is non-planar.

11. A golf club head comprising
a face component, a crown, and a sole; and
a hosel having a shaft connection point and a head connection point;
wherein the hosel has a vertical length of between 0.25 and 1.5 inches,
wherein the hosel has at least one thickness and at least one chord length
wherein the hosel has a variable thickness to chord ratio, and
wherein the thickness to chord ratio increases from the head connection point to the shaft connection point.

12. A golf club head comprising
a face component, a crown, and a sole; and
an airfoil-shaped hosel having a shaft connection point and a head connection point;
wherein the hosel has a vertical length of between 0.25 and 1.5 inches,
wherein the hosel has at least one thickness and at least one chord length, and
wherein the chord length remains constant from the head connection point to the shaft connection point of the hosel.

13. A golf club head comprising
a face component, a crown, and a sole; and
a hosel having a shaft connection point and a head connection point;
wherein the hosel has a vertical length of between 0.25 and 1.5 inches,
wherein the hosel has at least one thickness and at least one chord length, and
wherein the chord length increases from the head connection point to the shaft connection point of the hosel.

14. A golf club head comprising
a face component, a crown, and a sole; and
a hosel having a shaft connection point and a head connection point;
wherein the hosel has a vertical length of between 0.25 and 1.5 inches,
wherein the face component has a vertical plane and the head connection point has a vertical plane,
wherein the shaft connection point of the hosel is closer to the face component vertical plane than the head connection point vertical plane, and
wherein the hosel is staggered.

* * * * *